United States Patent [19]

Cline et al.

[11] 4,239,556

[45] Dec. 16, 1980

[54] SENSITIZED STAINLESS STEEL HAVING INTEGRAL NORMALIZED SURFACE REGION

[75] Inventors: Harvey E. Cline, Stanford, Calif.; Thomas R. Anthony; Harvey D. Solomon, both of Schenectady, N.Y.

[73] Assignee: General Electric Company, Schenectady, N.Y.

[21] Appl. No.: 972,238

[22] Filed: Dec. 22, 1978

[51] Int. Cl.[3] ..... B32B 38/40; C21D 1/34; C22C 38/40

[52] U.S. Cl. ..... 148/38; 148/39; 148/136; 428/636

[58] Field of Search ..... 148/4, 37, 38, 39, 136, 148/137, 145, 152; 75/65 EB, 65 ZM; 427/35, 53; 219/121 L, 121 LM, 121 EB, 121 EM; 428/636

[56] References Cited

U.S. PATENT DOCUMENTS

| | | | |
|---|---|---|---|
| 3,303,319 | 2/1967 | Steigerwald | 75/65 R |
| 3,505,126 | 4/1970 | Antes | 148/1 |
| 3,514,344 | 5/1970 | Smith et al. | 148/136 |
| 3,773,565 | 11/1973 | Pye et al. | 148/4 |
| 3,802,927 | 4/1974 | Gomada | 148/4 |
| 3,944,443 | 3/1976 | Jones | 148/20.3 |
| 3,952,180 | 4/1976 | Gnanamutho | 219/121 LM |
| 4,007,038 | 2/1977 | Devesell | 148/38 |
| 4,032,367 | 6/1977 | Richardson et al. | 148/38 |
| 4,122,240 | 10/1978 | Banas et al. | 427/35 |

FOREIGN PATENT DOCUMENTS

| | | | |
|---|---|---|---|
| 2134662 | 1/1973 | Fed. Rep. of Germany | 148/4 |
| 51-1013312 | 2/1976 | Japan | 148/136 |

*Primary Examiner*—L. Dewayne Rutledge
*Assistant Examiner*—Peter K. Skiff
*Attorney, Agent, or Firm*—Stephen S. Strunck; James C. Davis, Jr.; Leo I. MaLossi

[57] ABSTRACT

A body of sensitized stainless steel is afforded passivity for exposure to a corrosive environment by an integral surface region of normalized stainless shell formed in situ by laser beam scanning.

5 Claims, 8 Drawing Figures

SENSITIZED STAINLESS STEEL HAVING INTEGRAL NORMALIZED SURFACE REGION

BACKGROUND OF THE INVENTION

1. Field of the Invention

This invention relates to integral normalized surface regions formed in situ on bulk sensitized stainless steel by laser beam scanning.

2. Description of Prior Art

Heretofore, normalized stainless steel has been made by annealing a specimen of stainless steel in the solution temperature range for a time sufficient to allow a homogenization of the chromium concentration in the stainless steel, followed by quenching of the same specimen by bringing it in contact with a cold fluid.

With a sufficiently fast quench, the homogeneous chromium concentration is retained on quenching and a normalized stainless steel specimen is obtained. However, such a bulk quenching technique is not always feasible because forming operations, welding operations or the generation of large thermal stresses may prevent such a quenching step.

Stainless steels are alloys of iron and chromium or iron, chromium, and nickel with occasionally small amounts of other elements added to enhance their corrosion resistance or mechanical properties. In regard to corrosion resistance, the chromium content appears to be the controlling variable although the effect of chromium can be enhanced by the additions of nickel and molybdenum.

Stainless steels are available in three grades: namely, martensitic, ferritic, and austenitic. The martensitic grade containing about 12 wt% chromium is distinguished by its high hardness and is used for valves, valve seats and cutlery requiring a durable cutting edge. The ferritic grade containing about 16wt% chromium is more corrosion resistant but much less hard than the martensitic grade and can be formed and drawn. The austenitic grade has a fcc structure instead of the tetragonal and bcc structure of the martensitic and ferritic grades, respectively.

The basic and most widely used grade of the austenitic type is the "18-8" type containing 18 wt% chromium, 8 wt% nickel with 0.03 to 0.20 wt% carbon. Because of its high chromium content, it has excellent corrosion resistance. In addition, because of its fcc structure, it posseses very good ductility and is used in making the seamless stainless-steel tubing used in light water reactors. 304 stainless steel is a subclass of the "18:8" austenitic grade of stainless. Its carbon content is slightly higher than the average austenitic grade.

Although 304 stainless is generally very resistant to corrosion, under certain conditions it can become "sensitized" so that it is susceptible to susceptible to catastrophic intergranular corrosion. FIG. 1 shows the equilibrium phase diagram for 304 stainless with the temperature plotted against its carbon content. It must be stressed that this is the equilibrium diagram, although the phase diagram indicates that $\alpha$-ferrite can only be produced by severe cold working of the 304 stainless steel because of the extreme sluggishness of the $\gamma$-to-$\alpha$ phase transformation. Consequently, in practice the $\gamma$-austenite is retained as a metastable phase at room temperature and, thus, 304 stainless in its annealed unstrained state is austenitic.

In FIG. 1, it can be seen that the solubility of carbon in the alloy rapidly decreases with temperature between 900° C. and 400° C. Since most 304 stainless steels have about 0.1 wt% carbon, a super-saturated solution of carbon forms as the alloy is cooled below 900° C. Given a sufficient amount of time in the "sensitization" temperature range, it is found experimentally that carbon will precipitate out along grain boundaries in the form of chromium carbide, $Cr_{23}C_6$, FIG. 2. These thin two-dimensional-like carbides form on the grain boundary because the boundary is the only region where chromium atoms have sufficient mobility at these temperatures to diffuse to a carbide nucleus.

According to chromium-depletion theory of sensitization, the formation of these chromium-rich carbides along the boundary depletes the boundary and adjacent zones of chromium since at these temperatures chromium diffusion from the matrix is not rapid enough to replenish the chromium removed around the carbide. Thus, the chromium concentration at the boundary falls below that required for passivation, FIG. 2, allowing the boundary region to be corroded. A second theory also based on chromium depletion holds that the severe grain-boundary attack is a result of the galvanic cell that is formed between the bulk and the grain-boundary-zone $\gamma$-austenite and that a fall of chromium concentration below that required for passivation is not necessary.

It is found that if a stainless-steel specimen is cooled rapidly through the sensitization temperature range (FIG. 1), sensitization can be avoided. However, such a bulk treatment is not always feasible because forming operations, welding operations, or the generation of large thermal stresses may prevent such a quenching operation. In such cases, other ways must be found to prevent the severe intergranular corrosion that is associated with sensitization.

An object of this invention is to provide protective coating for a body or region of sensitized austenitic grade stainless steel.

Another object of this invention is to provide a new form of normalized stainless steel that can be employed in circumstances where bulk normalized stainless steel can not be formed.

A further object of this invention is to provide a body of sensitized stainless steel with an integral surface region of normalized stainless steel formed in situ by melting and rapidly quenching the material of the surface region.

Other objects of this invention will, in part, be obvious and will, in part, appear hereafter.

BRIEF DESCRIPTION OF THE INVENTION

In accordance with the teachings of this invention there is provided a body having a core of sensitized austenitic grade stainless steel such as Type 304 stainless steel. An integral outer surface region of normalized stainless steel encompasses the core to impart passivity to the stainless steel article in a corrosive environment.

The microstructure of the material of the body has carbon precipitated in the grain boundaries as chromium carbide in the sensitized material of the core. The integral outer surface region has a homogenized chromium concentration throughout its microstructure.

The structure of the integral outer surface region of normalized stainless steel consists of a series of mutually overlapping integral scallop shape regions. The thickness of the normalized region may be up to 10 millimeters.

DESCRIPTION OF THE INVENTION

We have discovered that by scanning a laser beam over the entire, or a portion of the, surface of a body of sensitized stainless steel, a thin layer of the stainless steel contiguous to the surface is first melted, and then rapidly self-quenched, forming a barrier layer of normalized austenite (normalized=nonsensitized) at the surface from the original material of the body. In subsequent corrosion tests, it has been discovered that this normalized barrier completely prevents intergranular corrosion. The integral normalized surface region has a homogeneous chromium concentration throughout the normalized region. The depth, or thickness, of the normalized region may be as great as 10 millimeters.

Figure 3:
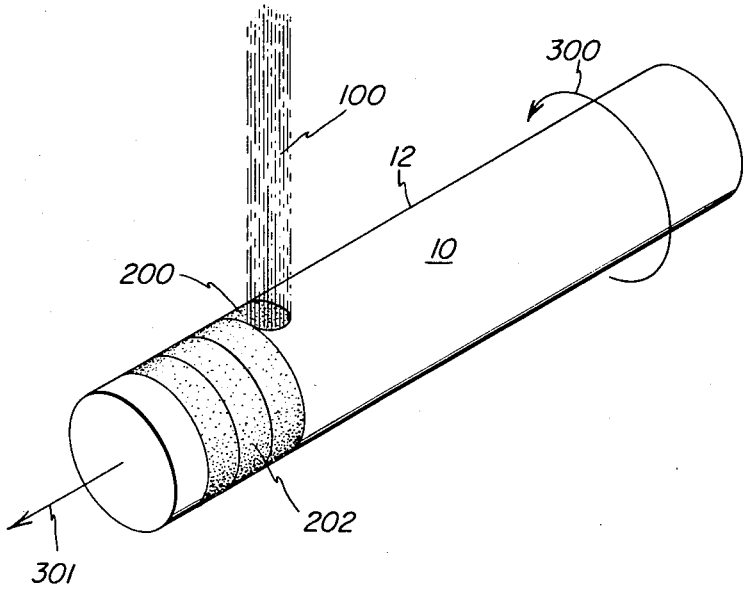
FIG. 3 is a schematic illustration of laser processing of a sensitized stainless steel rod with two different overlapping scan modes.

Referring now to FIG. 3, there is shown a rod-like body 10 of sensitized stainless steel undergoing laser surface normalization. The body 10, or portion thereof, whichever is applicable, is cleaned by a suitable method such as shotpeening, chemical etching, sand blasting, and the like. An opaque coating is then applied to the portion of the surface to be normalized. Suitable materials are black paint, a coating of black chrome, a coating of finely divided nickel and the like. The opaque coating is applied to minimize the reflection of a laser beam or an electron beam and to retain and/or absorb heat more efficiently for practicing the invention.

Although an electron beam or a flame may be employed in practicing this invention, the preferred method is the utilization of a laser beam. Presently, it is the most economical of the methods suggested and further, it does not require the use of a vacuum chamber.

The passes across the workpiece necessary to achieve the end result can be accomplished in several ways. The work piece, the beam or both can be moved in an X-Y direction to provide the necessary relative translation. Additionally, an optical system may be employed to scan the workpiece and process the surface region as required.

A laser beam 100 impinges on the stainless steel body 10 forming a melt path 200 on the surface 12 of the body 10. The body 10 is forced to undergo simultaneously a rotation 300 about the major axis of body 10 and a gradual translation 301 parallel to the major axis of body 10. This simultaneous rotation 300 and translation 301 causes the laser beam 100 to form a series of overlapping passes 202 over the surface of body 10. The overlapping distance is sufficient to ensure complete normalization of the surface region treated.

The power of the laser beam 100 is sufficient at the given laser beam scan rate to form a melt puddle 200 of a predetermined depth. The rapidly quenched ($\sim$100° C./sec or greater) material 202 in the surface layer 12 of body 10 is normalized and resists intergranular corrosion.

In order for the resolidified surface layer to be normalized, sufficient time must elapse at high temperatures for diffusion leveling of the chromium-concentration gradient. Since the diffusion constant in the liquid $D_L$ is much greater than the diffusion constant $D_s$ in the solid, the time $\tau$ that the surface layer is liquid is important. If $\delta$ is the radius of the melt pool beneath the laser beam moving at velocity V, then $$\tau = 2\delta/V \tag{1}$$

The diffusion distance X over which concentration homogenization can occur is $$X = (D_L\tau)^{\frac{1}{2}} = (2D_L\delta/V)^{\frac{1}{2}} \tag{2}$$

Figure 2:
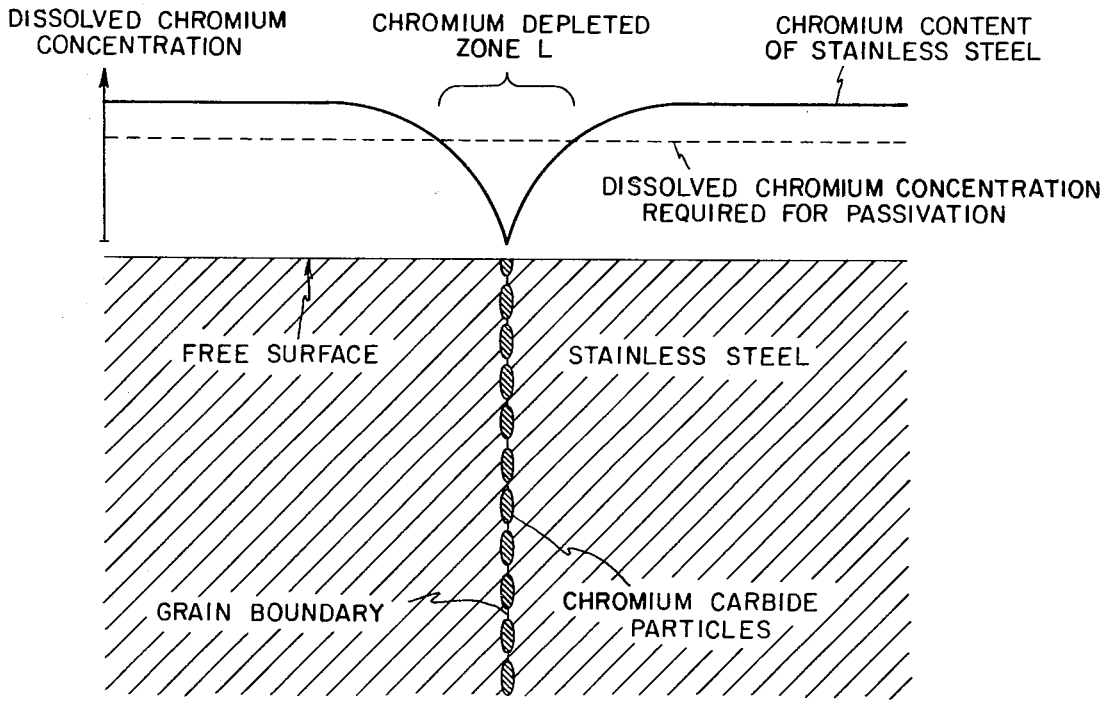
FIG. 2 is a schematic illustration of the chrome depletion mechanism of stainless steel sensitization.

From Equation (2) and the condition that X>L(the width of the chromium depleted zone - see FIG. 2), the maximum laser-scan velocity $V_{max}$ with which normalization will still occur is $$V_{max} \leqq 2D_L\delta/L^2 \tag{3}$$

Homogenization in the liquid is also aided by the fluid flow that occurs in the melt puddle beneath the laser beam. This mixing phenomenon, however, also dies out above a critical velocity estimated to be about 9 cm/sec for 304 stainless steel.

A similar analysis can be carried out to determine whether normalization can occur in the solid beneath the melt puddle. In this case, the liquid diffusion coefficient is replaced by the much smaller solid-state diffusion coefficient $D_s$. The maximum laser scan velocity then equals about $3\times10^{-2}$ cm/sec, in order to allow enough time for normalization in the solid.

As shown above, a maximum critical laser velocity exists above which normalization will not occur. In addition, there is a minimum critical laser velocity below which permanent normalization is not possible. The physical cause of the maximum laser velocity limit was the time reqwuired for diffusional homogenization in the liquid. In contrast, the physical source of the minimum laser velocity limit is the minimum quench rate required to cool the material through the sensitization range without resensitizing the material normalized by laser surface melting.

Figure 4:
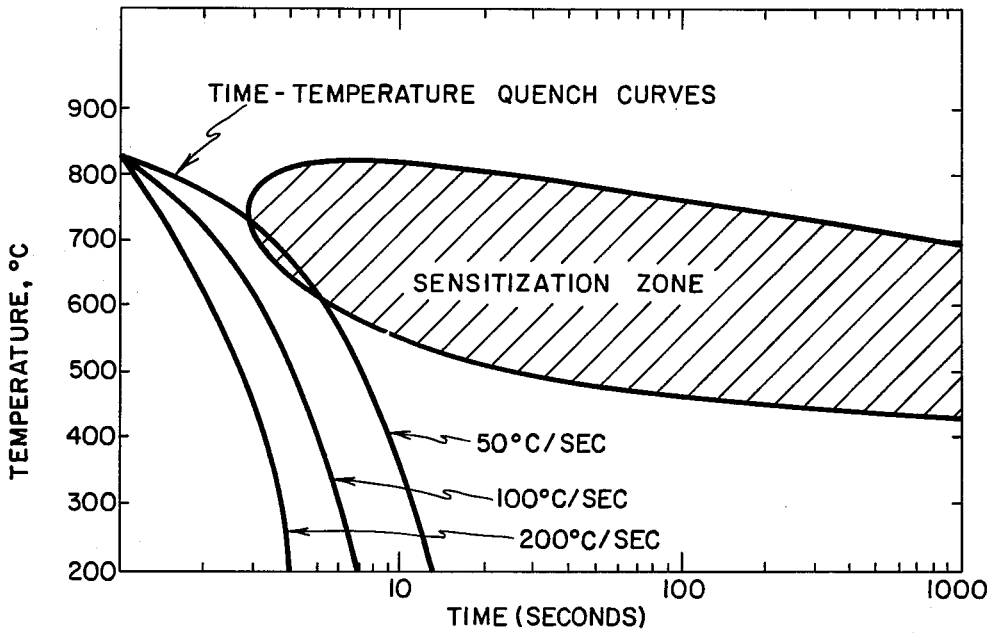
FIG. 4 is the temperature-time-sensitization diagram for 304 stainless steel.

Referring now to FIG. 4, the temperature-time-sensitization diagram for 304 stainless steel is shown. Specimens held for times and temperatures shown in the sensitization zone would be susceptible to corrosion. Several time-temperature quenching curves are superimposed on FIG. 4. From them it can be seen that a minimum quench rate of 100° C./sec is required to prevent resensitization.

Figure 5:
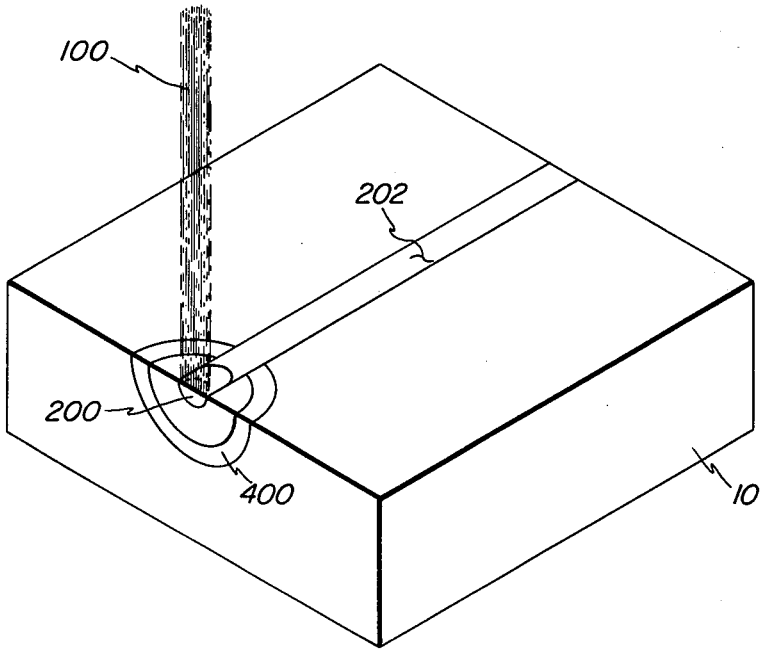
FIG. 5 is a schematic illustration of a cross-section perpendicular to the path of a laser beam which is melting the surface of a sensitized 304 stainless steel slab.

Referring now to FIG. 5, a cross-section perpendicular to the path of a laser beam 100 melting the surface of the body 10 of sensitized stainless steel. Beneath the laser beam 100, a puddle 200 of liquid stainless steel is formed which subsequently resolidifies to form the laser beam melt path 202. The temperature of material of body 10 is raised by the beam so that material in zone 400 passes through the sensitization temperature range. Material in zone 400 must pass through this sensitization temperature range quickly to avoid sensitization.

The quench rat $$\frac{\partial T}{\partial t}$$

of material in zone 400 is simply related to the laser surface scanning velocity V by $$\frac{\partial T}{\partial t} V \cdot \overline{\nabla T}, \tag{4}$$

where VT is the temperature gradient in the material. If the laser beam is moving in the X direction, by dimensional analysis, the time-averaged temperature gradient at a point in the specimen with temperature T is approximately $$\frac{\partial T}{\partial X} \cong \frac{V}{D_T} T, \tag{5}$$

where V is the laser velocity, T is the temperature and $D_T$ is the thermal diffusion constant of the material. By setting $T = T_{sens}$ and combining Equations (4) and (5), the time-averaged quench rate of material in the sensitization range is found to be $$\left.\frac{\partial T}{\partial t}\right)_{sens} = \frac{V^2}{2D_T} T_{sens}. \tag{6}$$

Equation (6) can be rearranged to determine the minimum laser-scan velocity $V_{min}$ to prevent resensitization.

$$V_{min} \geqq \left[\frac{2D_T}{T_{sens}}\left(\frac{-\partial T}{\partial t}\right)_{min}\right]^{\frac{1}{2}} \tag{7}$$

For a minimum quench rate of −100° C./sec from FIG. 4, the minimum allowed laser velocity is $V_{min} \geqq 1.3 \times 10^{-1}$ cm/sec. This value compares with the maximum permissible laser-scan velocity of 6 cm/sec required for initial normalization. Thus there is approximately only an order-of-magnitude window in laser-scanning rates which are compatible with surface normalization of sensitized stainless steels by laser surface melting.

The following example is illustrative of the teachings of this invention.

Figure 1:
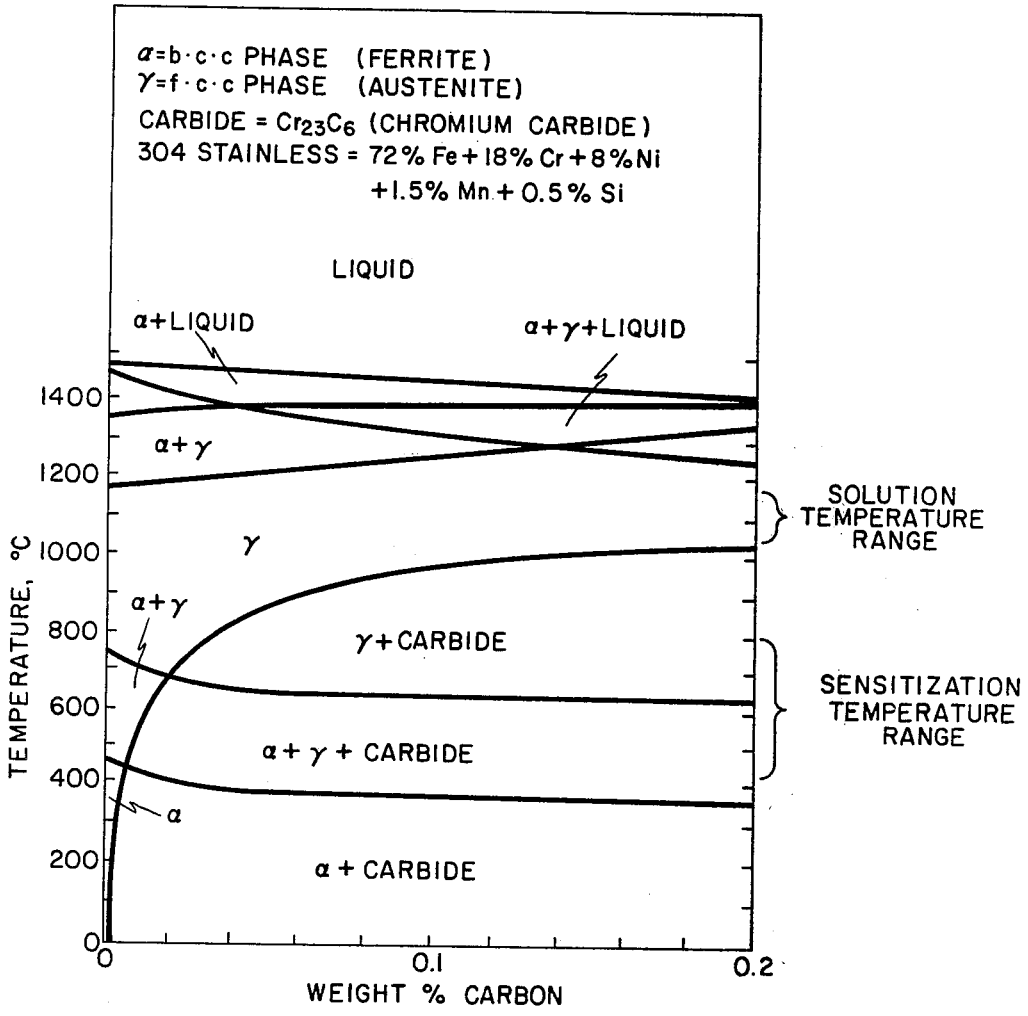
FIG. 1 is the equilibrium phase diagram of 304 stainless steel with its carbon content plotted versus temperature. The "solution" temperature range in which carbon may be readily dissolved in $\gamma$-austenite is shown as well as the "sensitization" range where chromium carbides are observed to precipitate out on the grain boundaries of stainless steel causing sensitization thereof.

Specimens of 304 stainless steel with the properties shown in the following Table were annealed for 1 h at 1100° C. in the solution temperature range (FIG. 1) so that any precipitated carbon in the sample would redissolve. After this solution treatment, the specimens were water quenched and then annealed at 650° C. in the sensitization temperature range for 24 h to cause chromium carbides to form on the grain boundaries of the specimen. Following the sensitization anneal at 650° C. the samples were then water quenched. The samples were rod specimens 0.32 cm in diameter by 5 cm in length.

TABLE

Properties of 304 Stainless Steel Specimens

Composition (wt %):

| Cr | Ni | Mn | Si | C | S | P | Cu | Mo |
|---|---|---|---|---|---|---|---|---|
| 18.3 | 9.1 | 1.6 | 0.6 | 0.06 | 0.03 | 0.03 | 0.09 | 0.3 |

| | |
|---|---|
| Yield strength: | $2.31 \times 10^9$ dyn/cm$^2$ |
| Ultimate tensile strength: | $5.78 \times 10^{+9}$ dyn/cm$^2$ |
| Ductility: | 66% plastic deformation before failure |
| Young's modulus: | $2 \times 10^{+12}$ dyn/cm$^2$ |
| Poisson's ratio: | 0.28 |
| Thermal expansion coefficient: | $18.4 \times 10^{-6}$/°C. |
| Grain size: | approximately $8 \times 10^{-3}$ cm |

A $cwCO_2$ laser (maximum power, 350W) with a spot size diameter of $2.5 \times 10^{-2}$ cm scanned at a rate of 0. 5 and 1 cm/sec at power levels of 70, 80, 140, 180, and 200W, respectively over sensitized specimens of 304 stainless steel 0.32 and 0.65 cm in diameter.

For reasons of convenience, the test rods were scanned by rotating the rod about its major axis under the laser beam while gradually translating the rod parallel to its major axis.

Figure 6:
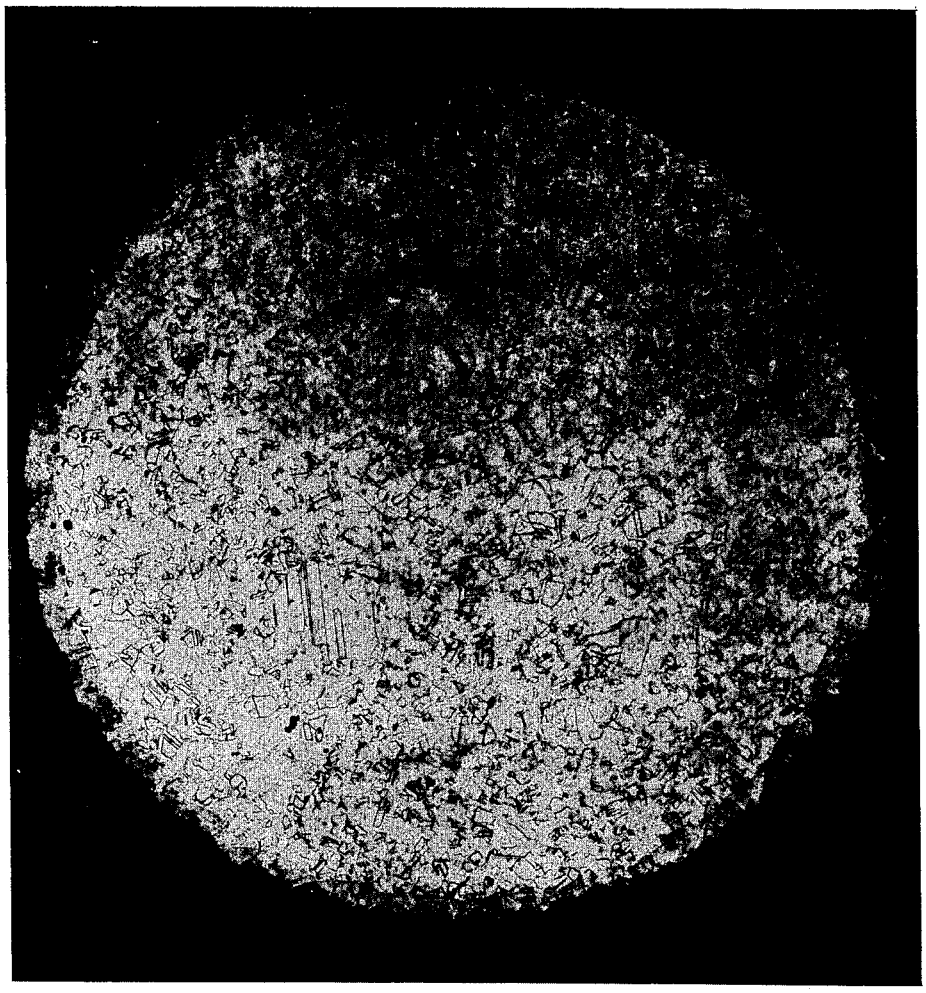
FIG. 6 is a photomicrograph of a cross-section of a sensitized 304 stainless steel rod which has been laser surface melted (63X).

FIG. 6 is a photomicrograph at 63X of a cross-section of 0.32-cm-diam Type 304 stainless steel rod after laser processing by the mode depicted in FIG. 3. Processing was done at a scan rate of 0.5 cm/sec and a laser power of 140W. The observed penetration depth of $1 \times 10^{-2}$ cm agrees well with theoretical predictions. The scallop shape of each pass is visible in FIG. 6 as well as the fact that the surface is well covered because of the overlay between adjacent passes. The normalized surface region produced from the original material comprising the body completely encases the core of sensitized stainless steel. There are no sighns of sensitization in the normalized surface region.

Figure 7:
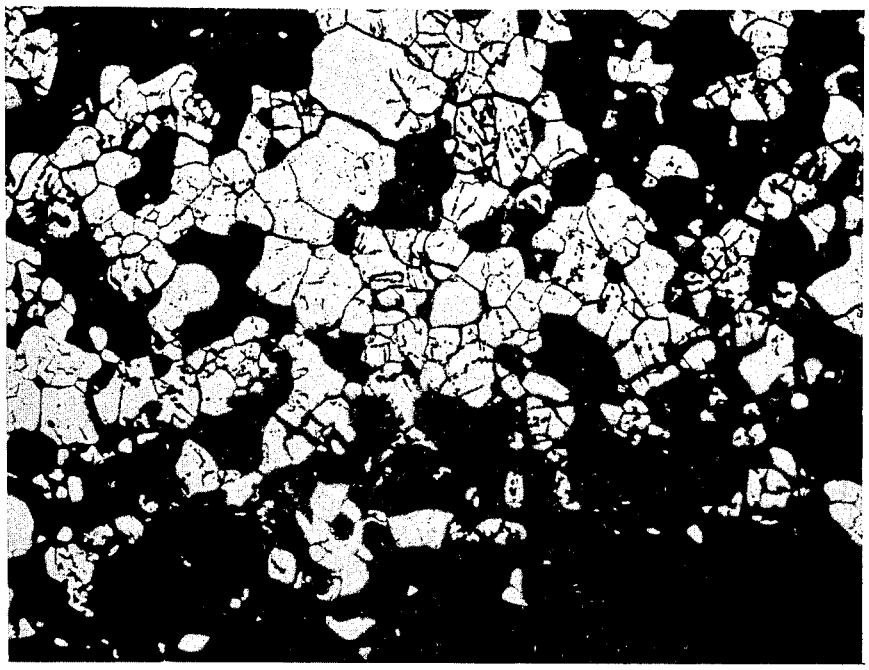
FIG. 7 is a photomicrograph of a cross-section of a sensitized stainless steel specimen after a 72 hour exposure to a boiling solution of 10% $H_2SO_4$, 10% $CuSO_4$, and 80% $H_2O$.(275x)
Figure 8:
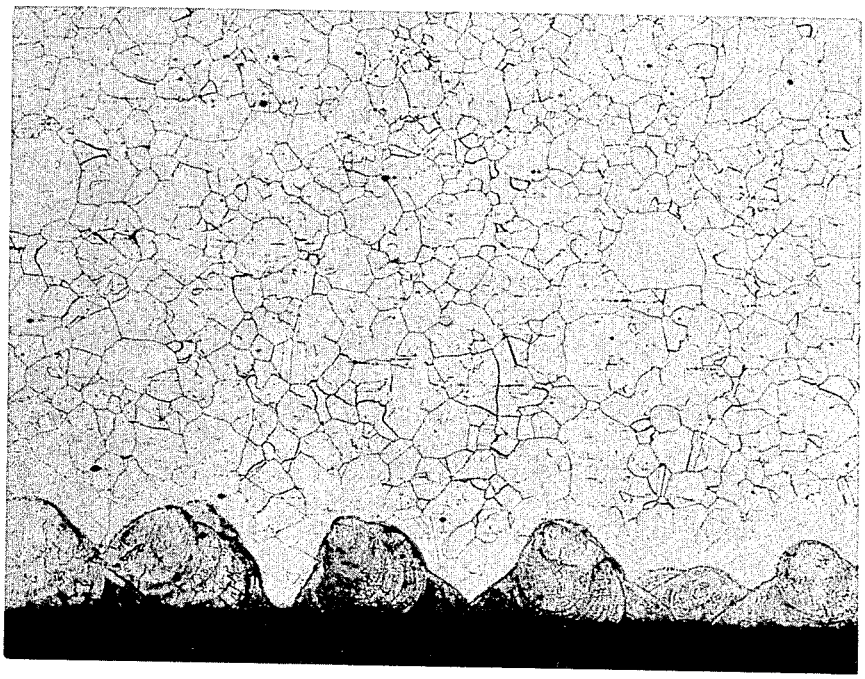
FIG. 8 is a photomicrograph of a cross-section of a sensitized stainless steel rod identical to the rod of FIG. 6 except for a surface normalization by laser surface melting (275X).

The processed specimens were subjected to the standard Strauss test (ASTM-A262 practice E test solution) in a boiling solution of 10% $H_2SO_4$ and 10% $CUSO_4$ for 7 hours. As expected, there was complete grain-boundary disintegration of rods which were not surface treated by the laser scanning technique (FIG. 7). In contrast, in the rod where laser surface melting had occurred, there was a complete absence of attack (FIG. 8). The protective effect in the form of a normalized surface region obtained from laser surface melting is thus shown.

Although the invention has been described relative to the surface treatment of sensitized stainless steel, the same surface treatment may be practical on articles of manufacture as fabricated. Without having to determine the metallurgical microstructure of the article, one may surface treat the article to insure resistance to corrosive atmospheres which would be detrimental to sensitized stainless steels.

We claim as our invention:

1. An article of manufacture comprising a discrete body of an austenitic grade of stainless steel including a sensitized core with an integral outer surface region of normalized austenite steel formed in situ from the core and encompassing said core to a depth in the range of from about $1\times10^{-2}$ cm to 1 cm and to impart passivity to the stainless steel body in a corrosive environment, said region being characterized by having the chromium content thereof homogenized throughout said region with substantially all precipitated carbides being absent from said region, including the grain boundaries, said region being further characterized in that the chemical composition of said region is the same as the chemical composition of said core.

2. The article of manufacture of claim 1 wherein the metallurgical microstructure of the sensitized stainless steel of the core has carbon precipitated out in the grain boundaries in the form of chromium carbide.

3. The article of manufacture of claim 1 wherein the structure of the integral outer surface region of normalized austenitic stainless steel consists of a series of mutually overlapping integral scallop shape regions.

4. The article of manufacture of claim 3 wherein the type of austenitic grade stainless steel is 304.

5. The article of manufacture of claim 4 wherein the thickness of a scallop-like portion of the integral outer surface region is approximately $1\times10^{-2}$ centimeters.

* * * * *

UNITED STATES PATENT AND TRADEMARK OFFICE

CERTIFICATE OF CORRECTION

PATENT NO. : 4,239,556
DATED : December 16, 1980
INVENTOR(S) : Harvey E. Cline, Thomas R. Anthony, Harvey D. Solomon It is certified that error appears in the above—identified patent and that said Letters Patent is hereby corrected as shown below:

ON THE TITLE PAGE:

In the References Cited:

1. delete "Gnanamutho" and insert therefor -- Gnanamuthu --

2. delete "Devesell" and insert therefor -- Deverell --

In the Abstract:

line 3, delete "shell" and insert therefor -- steel -- col. 1, line 53, delete the colon (:) between 18 and 8 and insert therefor a dash (-)

col. 1, line 57, delete "susceptible to" (first occurrence)

col. 4, line 65, delete "reqwuired" and insert therefor -- required -- col. 5, line 21, delete "rat" and insert therefor -- rate -- col. 5, line 30, delete equation (4) as shown and insert therefor $$-- \quad \frac{\partial T}{\partial t} = V \bullet \overline{\nabla T} \qquad (4) \quad --$$

col. 5, line 33, delete "VT" and insert therefor -- $\overline{\nabla T}$ --

UNITED STATES PATENT AND TRADEMARK OFFICE

CERTIFICATE OF CORRECTION

PATENT NO. : 4,239,556
DATED : December 16, 1980
INVENTOR(S) : Harvey E. Cline, Thomas R. Anthony, Harvey D. Solomon It is certified that error appears in the above—identified patent and that said Letters Patent is hereby corrected as shown below:

col. 6, line 50, delete "sighns" and insert therefor -- signs -- col. 6, line 54, delete "$CUSO_4$" and insert therefor -- $CuSO_4$ --

Claim 1, line 4 of the claim which reads, "surface region of normalized austenite steel formed", after "austenite" delete the word "steel"

Claim 1, line 7 of the claim which reads, "1 cm and to impart passivity to the stainless steel", after "1 cm" delete the word "and"

Signed and Sealed this

*Twenty-fourth* Day of *November 1981*

[SEAL]

*Attest:*

GERALD J. MOSSINGHOFF

*Attesting Officer*

*Commissioner of Patents and Trademarks*

Disclaimer 4,239,556.—*Harvey Ellis Cline,* Stanford, Calif.; *Thomas Richard Anthony* and *Harvey Donald Solomon,* Schenectady, N.Y. SENSITIZED STAINLESS STEEL HAVING INTEGRAL NORMALIZED SURFACE REGION. Patent dated Dec. 16, 1980. Disclaimer filed Oct. 29, 1981, by the assignee, *General Electric Co.*

Hereby enters this disclaimer to claims 1 through 5 inclusive of said patent.

[*Official Gazette Jan. 5, 1982*]